United States Patent [19]

Hermanson

[11] Patent Number: 4,607,653

[45] Date of Patent: Aug. 26, 1986

[54] COLLAPSIBLE UMBRELLA WITH CIRCULAR RIM

[76] Inventor: Terry Hermanson, c/o 41 Madison Ave., New York, N.Y. 10010

[21] Appl. No.: 709,683

[22] Filed: Mar. 8, 1985

[51] Int. Cl.[4] ..... A45B 19/10; A45B 19/00; A45B 11/00; A45B 21/00

[52] U.S. Cl. ..... 135/20 M; 135/25 R; 135/36 R

[58] Field of Search ..... 135/16, 17, 19, 20 R, 135/20 M, 29, 31, 36 R, 36 RT, 25, 25 A, 26

[56] References Cited

U.S. PATENT DOCUMENTS

| | | | |
|---|---|---|---|
| 833,724 | 10/1906 | Abbott | 135/20 R |
| 3,213,868 | 10/1965 | Forbes | 135/20 M |
| 3,467,114 | 9/1969 | McSherry | 135/20 R |
| 3,989,055 | 11/1976 | Saito | 135/25 A |
| 4,312,371 | 1/1982 | Koon | 135/20 R |
| 4,360,035 | 11/1982 | Dillman | 135/20 R |

FOREIGN PATENT DOCUMENTS

| | | | |
|---|---|---|---|
| 322095 | 7/1957 | Switzerland | 135/107 |
| 13308 | of 1850 | United Kingdom | 135/31 |

*Primary Examiner*—Robert E. Bagwill
*Assistant Examiner*—Terrence L. B. Brown
*Attorney, Agent, or Firm*—Sheridan Neimark; A. Fred Starobin

[57] ABSTRACT

A round rim umbrella where the rim members and their connecting hinges form a hoop without pointed projections with a center shaft construction involving a center rod within a hollow shaft and a sliding member fixed to the center rod through a slot in the hollow shaft. The strut structure is such as to allow the canopy to fold upward so that two bare rim pivotal connections act as tips of a walking stick without damage to the fabric of the umbrella.

11 Claims, 17 Drawing Figures

FIG. 7.
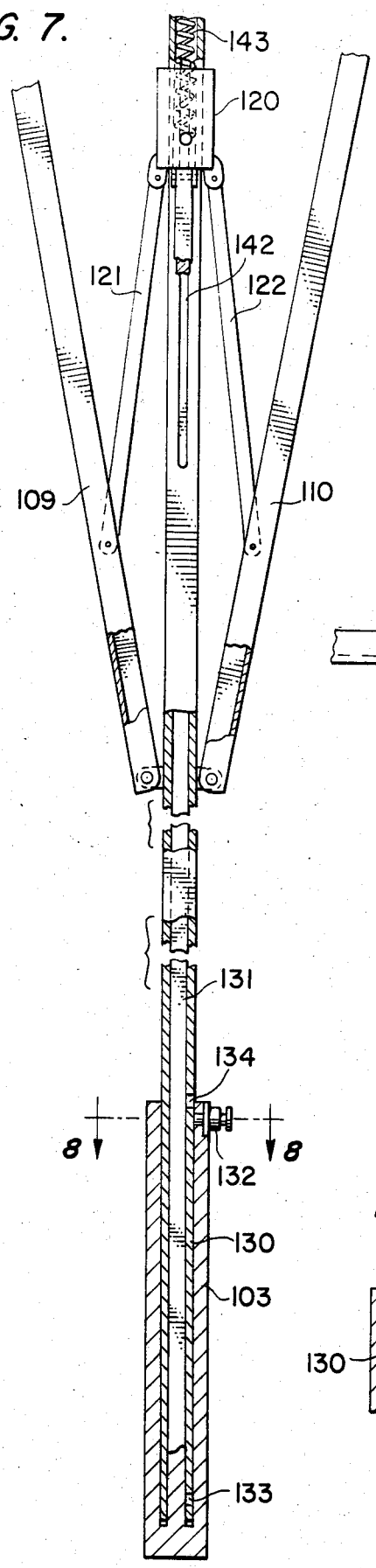
FIG. 9.
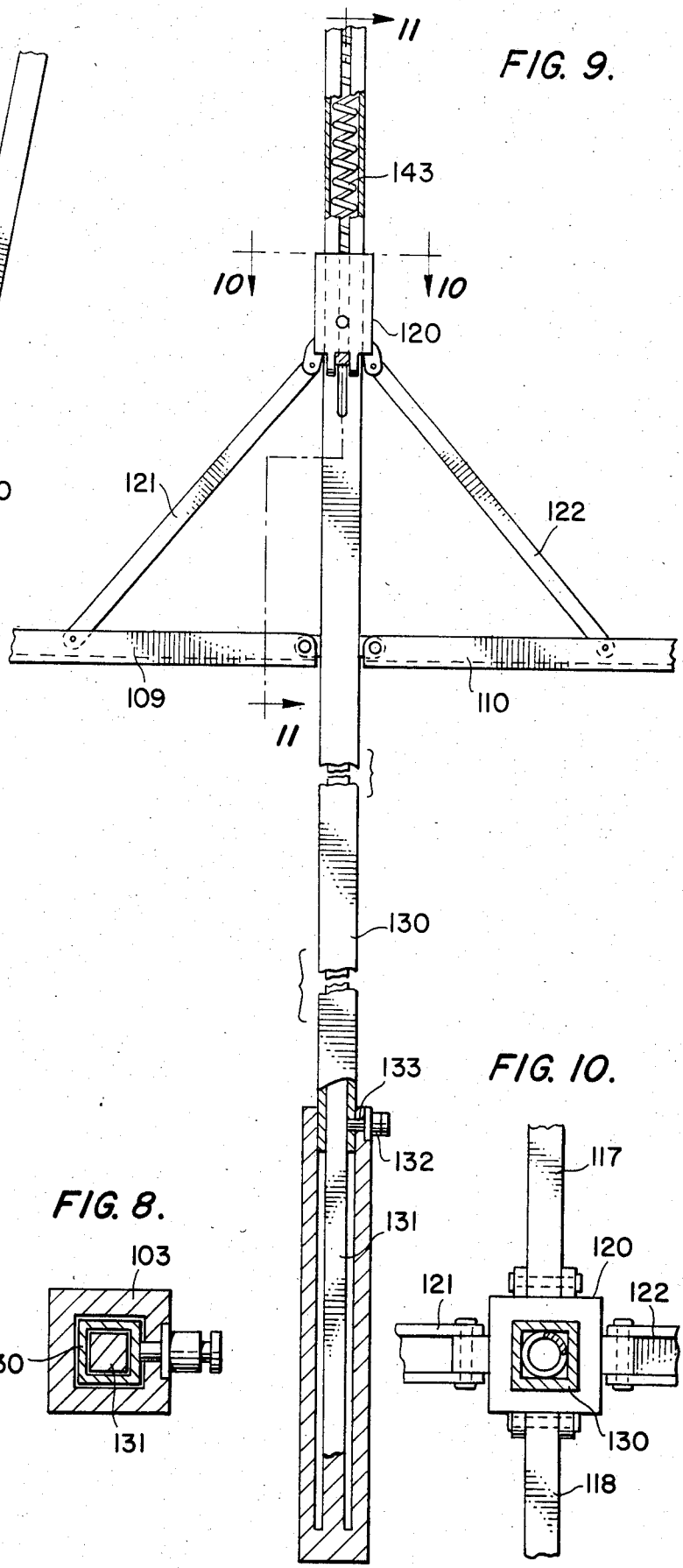
FIG. 8.
FIG. 10.

FIG. 11.
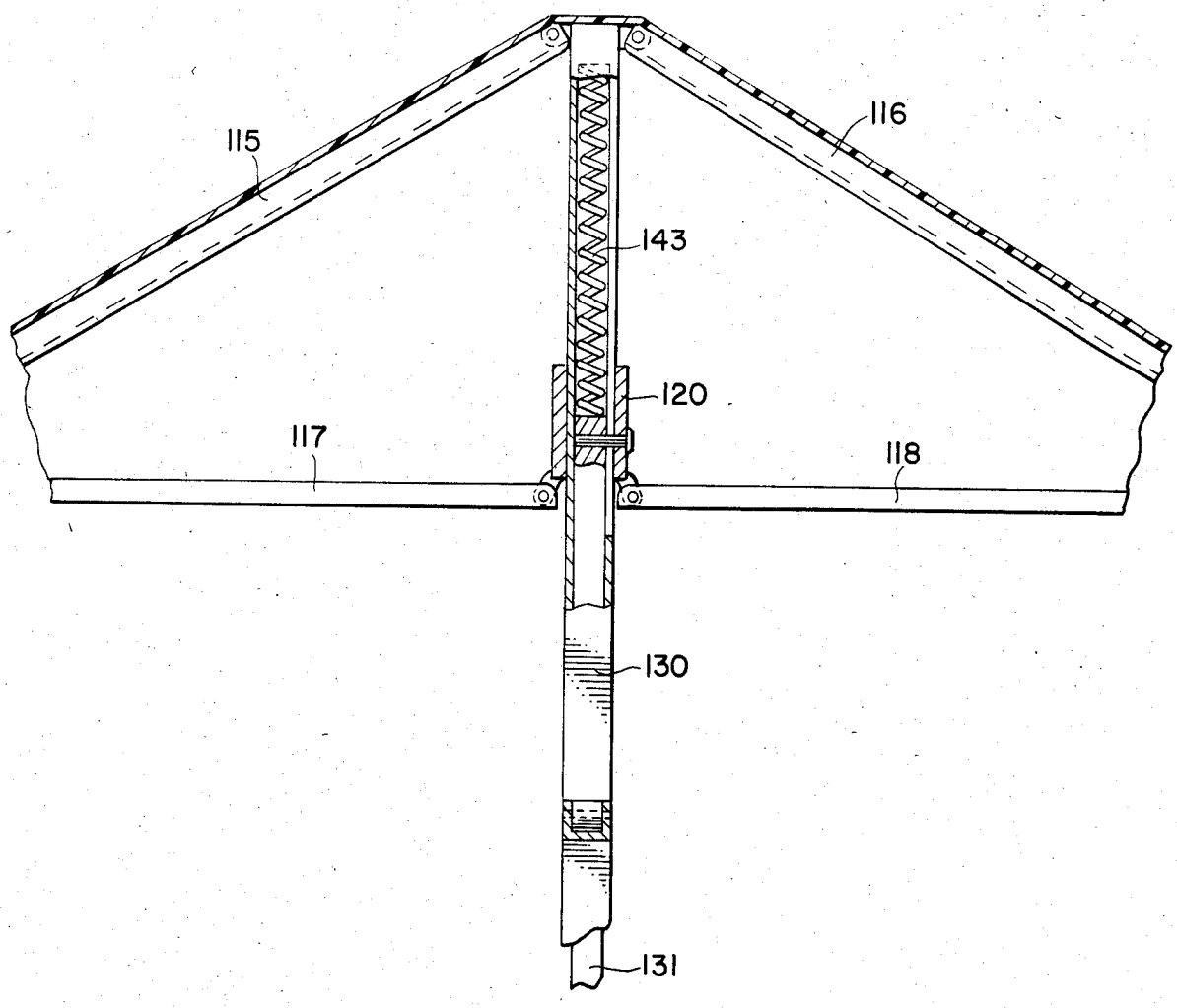
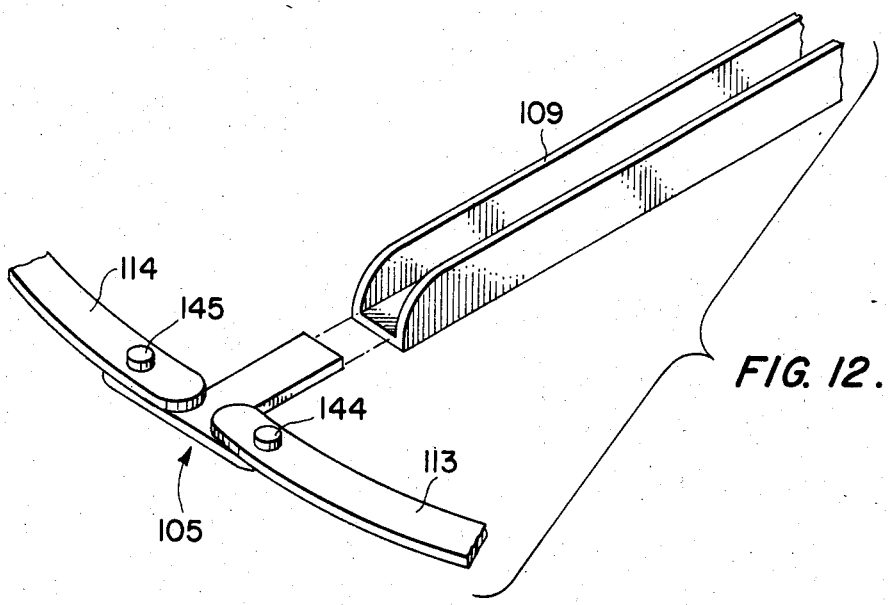
FIG. 12.

COLLAPSIBLE UMBRELLA WITH CIRCULAR RIM

BACKGROUND OF THE INVENTION

The present invention relates to the folding type of umbrella which opens to have a round rim and when closed can be used as a walking stick without damage to the fabric of the umbrella.

Umbrellas presently in use come in many shapes including round as with the present invention but these umbrellas have projections around the rim causing a danger to others passing by the user besides to the user when handling the umbrella especially when in a strong wind.

When a wet umbrella is closed the wet portion being on the outside as is the case with most presently used umbrellas can be annoying especially with a wet umbrella in the close quarters of a bus or train on a rainy day.

SUMMARY OF THE INVENTION

The present invention attempts to provide an umbrella of the type that will overcome the disadvantages of umbrellas presently in use.

With the umbrella of the present invention, in the open position, a hoop is formed with a convex rim which avoids dangerous points, especially dangerous to the eyes of those nearby and those handling the umbrella.

The present invention avoids the usual weak points in umbrella structure through the use of a hooped round rim.

The umbrella of the present invention utilizes a prestressed rim section that allows bending only in the direction to bend outward to form the rounded hoop.

On the umbrella of the present invention, the fabric of the canopy is placed on the rim members with the weave so as to permit maximum stretch on the bias for stretch to conform to the rounded rim.

The umbrella of the present invention utilizes hinges connecting the elements of the hoop which are exposed so as to protect the fabric from contact with the surface during use of the umbrella as a walking stick when the umbrella is in the closed position.

The circular shape of the umbrella of the present invention results in much more coverage for the user than prior art shaped umbrellas.

In accordance with the present invention a collapsible umbrella having straight elements in the collapsed position, forms a convex rimmed hoop in the open position.

BRIEF DESCRIPTION OF THE DRAWINGS

The foregoing and other advantages and features of the invention may best be understood by reference to the accompanying drawings, showing by way of illustration, preferred embodiments thereof, and in which:

FIG. 7 is a partially sectioned view of the lower internal mechanism of the umbrella in an almost closed position;

FIG. 8 is a sectioned view along line 8—8 of FIG. 7;

FIG. 9 is a partially sectioned view of the lower internal mechanism of the umbrella in an open position;

FIG. 10 is a sectioned view along line 10—10 of FIG. 9;

FIG. 11 is a sectioned view along line 11—11 of FIG. 9 showing the top internal mechanism of the umbrella in the open position;

FIG. 12 is an enlarged perspective view showing a rim tip mounted on connecting parts of the rim of the umbrella of the present invention.

DESCRIPTION OF THE PREFERRED EMBODIMENTS

Referring first to FIGS. 1–5 there is shown the umbrella 100 of the present invention as it is changed from a fully closed and bound position to a fully opened position. It is first shown in the closed position where all support members of the canopy 101 are in a position substantially parallel to the center shaft 102 and as it moves in succeeding figures to the open position where these rim support members are bent to form a convex or round figure.

Figure 1:
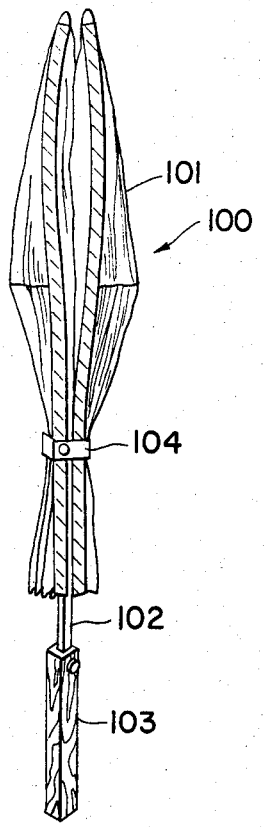
FIG. 1 is a perspective view of an embodiment of the umbrella of the present invention in the closed position.
Figure 2:
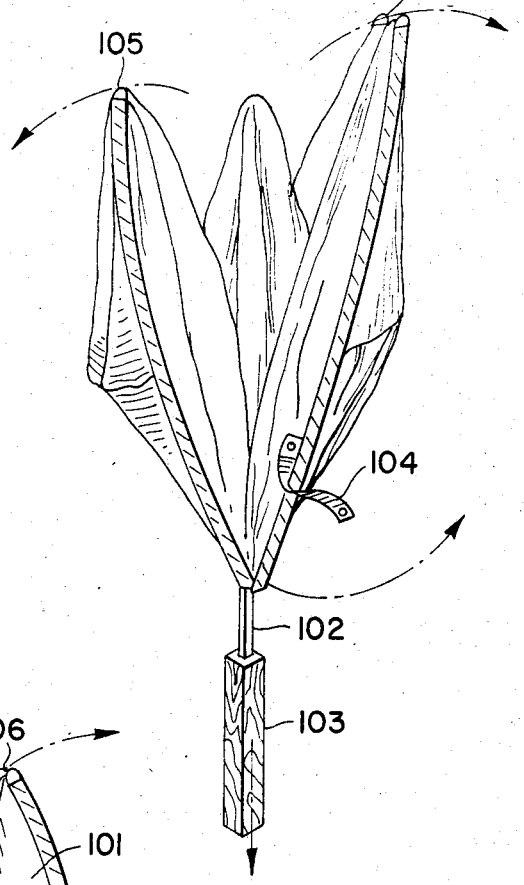
FIG. 2 is a perspective of the umbrella of FIG. 1 in a partially open position.
Figure 3:
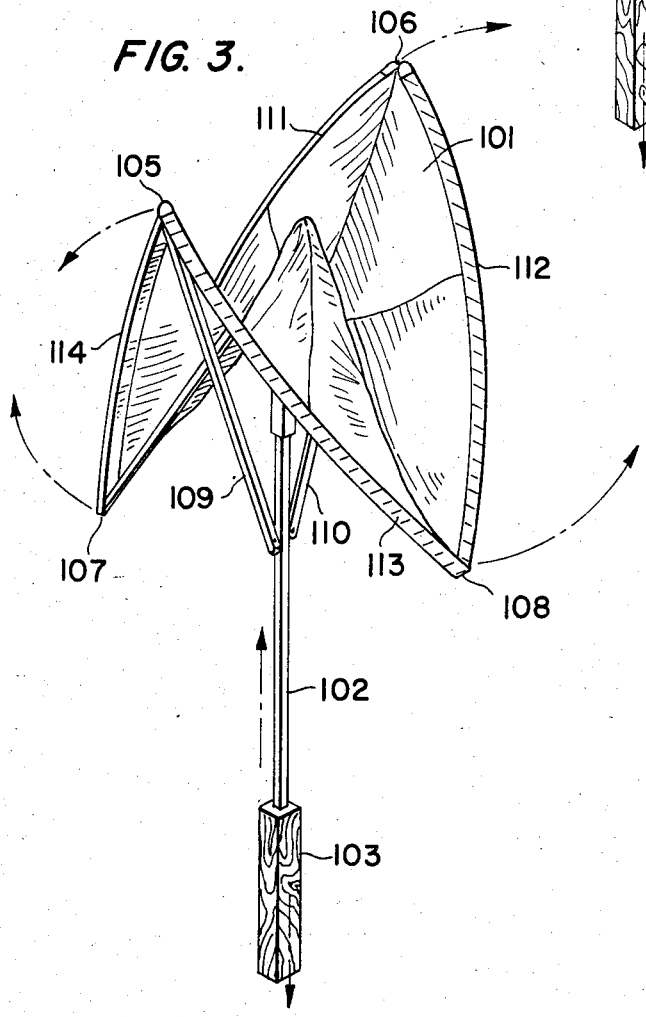
FIG. 3 is a similar view with the umbrella still further opened from the view of FIG. 2.
Figure 4:
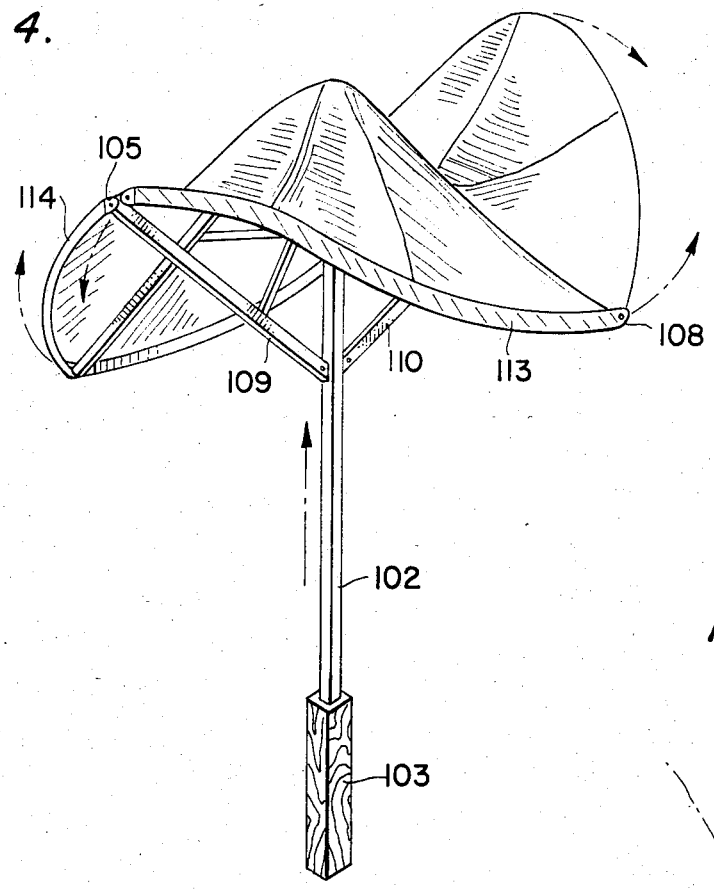
FIG. 4 shows the umbrella still further opened from the view of FIG. 3.
Figure 5:
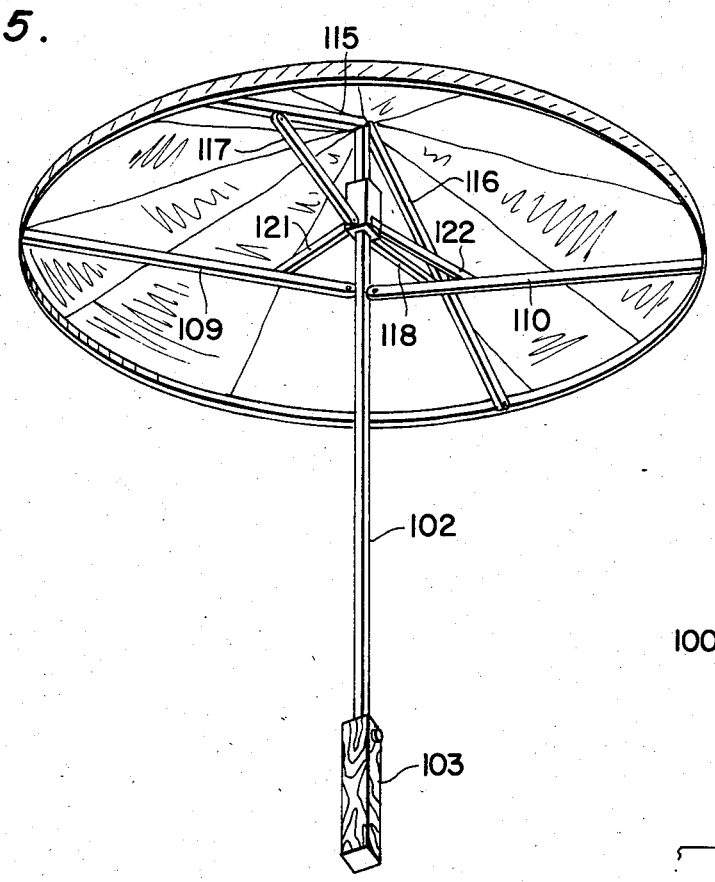
FIG. 5 shows the umbrella in the fully open position.

In FIG. 1 the canopy 101 is tightly bound around center shaft 102 which is mounted in handle 103. A strap 104 is shown to keep the umbrella in a tightly closed position. With strap 104 unsnapped, the umbrella is started toward an opened position as shown in FIG. 2. This is done by moving handle 103 downward in relation to center shaft 102 thereby moving opposite rim tips 105 and 106 away from each other and causing hinges 107 and 108 to open as further shown in FIG. 3. As seen in FIGS. 3 and 4 as the umbrella is continued toward its open position, the rim tips 105 and 106 are moved away from each other by the upward movement of the lower ends of upwardly extending supports 109 and 110 along center shaft 102. Also, rim members 111–114, during this movement are changed from their somewhat straight appearance to a convex shape as depicted in FIGS. 4 and 5. As shown in FIG. 5, during the opening process the members under canopy 101 have all extended thereby effecting the opening of the umbrella. Top support members 115 and 116 pivotally connected between the top of shaft 102 and hinges 107 and 108 respectively have spread as have intermediate connecting members 117 and 118 pivotally connected to a sliding member 120 on shaft 102 and to intermediate positions on top support members 115 and 116 respectively. Also pivotally connected to sliding member 120 are intermediate connecting members 121 and 122 which have their opposite ends pivotally connected to supports 109 and 110.

In order to obtain the proper stretch of the fabric of the canopy 101 the material is mounted with the weave of the fibers run so as to permit maximum stretch on the bias of the material.

Figure 6:
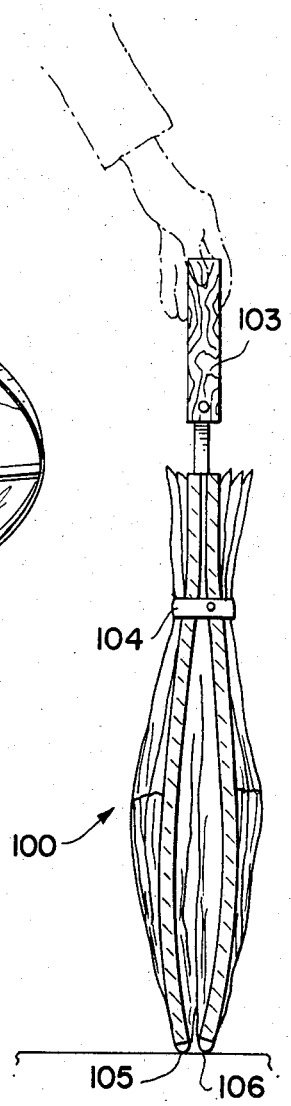
FIG. 6 shows the umbrella in the fully closed position being used as a walking stick.

When in the tightly closed position bound by strap 104, as shown in FIG. 6, the umbrella may be used as a walking stick without damage to the fabric of canopy 101 even though a part of the rim is being put in contact with the ground surface.

FIGS. 7 through 11 show the mechanism, including the internal mechanism of umbrella 100, used in the opening and closing of the umbrella.

This mechanism comprises center shaft 102 which is formed and shown in the present embodiment as a rectangular hollow shaft 130 which is adapted to slide on a center extending rod 131 which rod 131 is connected to and may be integral, as shown most clearly in FIGS. 8 and 9, with rectangular handle 103 at their bottoms so as to form a groove between the bottom portion of rod 131 and handle 103 within which rectangular hollow shaft 130 can slide. A plunger type of lock 132 is mounted on handle 103 to extend therethrough into holes 133 and 134 when the umbrella 100 is either in a fully open position as in FIG. 9 with the plunger of lock 132 inserted in hole 134 or when the umbrella 100 is in a fully closed position with the plunger of lock 132 inserted in hole 133, locking the umbrella in each of those positions.

Upon the movement of plunger lock 132 out of hole 134 the umbrella 100 is moved from its closed position by movement of rectangular hollow shaft 130 along center extending rod 131 out of the groove between rod 131 and handle 103. When hollow shaft 130 has moved sufficiently far along rod 131 for the umbrella 100 to be in its fully extended position, the plunger of lock 132 will be inserted by a spring action, which can be built into the lock, into hole 133 to maintain the umbrella in its open position.

With the movement of hollow shaft 130 along rod 131, pivot points 136 and 137 connecting supports 109 and 110 respectively to hollow shaft 130 are moved upward relative to center rod 131. At the same time, sliding member 120 is held stationary relative to center rod 131 by its pinned connection to rod 131 which extends through hollow shaft 130. Therefore intermediate connecting members 121 and 122 each of which have one of their ends connected at pivot points 138 and 139 respectively to sliding member 120 force upwardly extending supports 109 and 110 outward by their pivotal connections at pivot points 140 and 141 respectively. Although sliding member 120 is held stationary in relation to center rod 131 it is called thus because it appears to slide in relation to rectangular hollow shaft 130 with its pinned connection to rod 131 moving within slot 142 in hollow shaft 130. This movement toward the open position is helped by spring 143 mounted in hollow shaft 130 above the upper end of center extending rod 131. Spring 143 is held compressed when umbrella 100 is in the closed state and stretches when the umbrella is opened to aid in the opening of the umbrella.

FIG. 12 is an enlarged view of a rim tip 105 or 106 with connecting rim members. If, for example, rim tip 105 is the rim tip shown in the figure, then the rim members shown therein are rim members 113 and 114. Rim members 113 and 114 are pivotally connected to T shaped end of support 109 where the ends of rim members 113 and 114 substantially overlap pivot points 144 and 145 so that when rim members 113 and 114 are folded inward in the closing of umbrella 100, the tips of the rim members which have no fabric on the tips turn outward from the T member and form the bared tips of the walking stick depicted in FIG. 6. This same configuration is found at the end of support 110 where it connects with rim members 111 and 112.

In order for rim members to be sure to form a convex shape upon opening of the umbrella, they may be of a spring steel prestressed so as to assume that convex shape forming a round rim. Or the rim members may be formed of other material such as a laminated wood or plastic material where the outer lamination is cut so as to also cause the outward bend of the round rim.

Although an embodiment of the invention has been illustrated the invention should not be restricted to such embodiment since many changes are within the spirit of the invention. Among such changes it should be noted that instead of being rectangular, all parts can be round such as the handle, the center extending rod connected to the handle, the hollow shaft slidingly mounted on the center rod, and the sliding member connected to the center rod and slidingly mounted relative to the hollow shaft. Also the plunger lock illustrated could be of a type such as a spring clip operating from within the shafts.

This has been illustrated in a second embodiment as shown in FIGS. 13 through 17. Parts that operate substantially as in the first embodiment are numbered similarly but in a 200 series.

Figure 13:
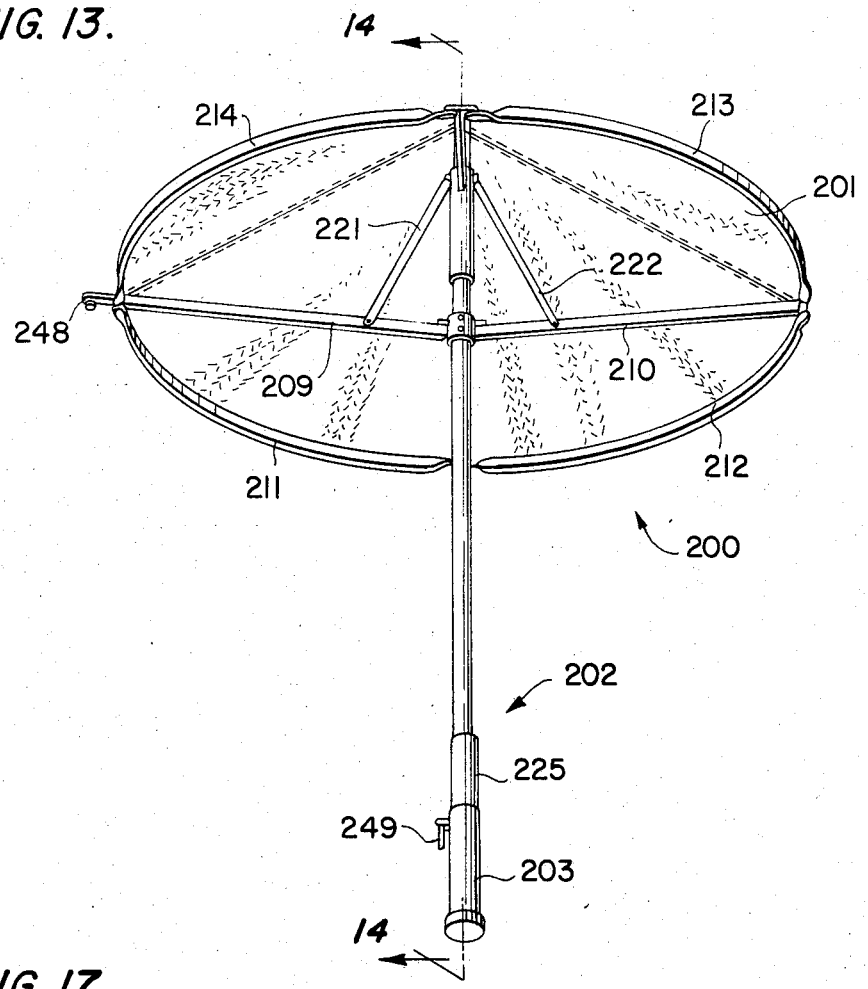
FIG. 13 is another embodiment of the umbrella of the present invention showing the umbrella of this embodiment in a fully open position.
Figure 16:
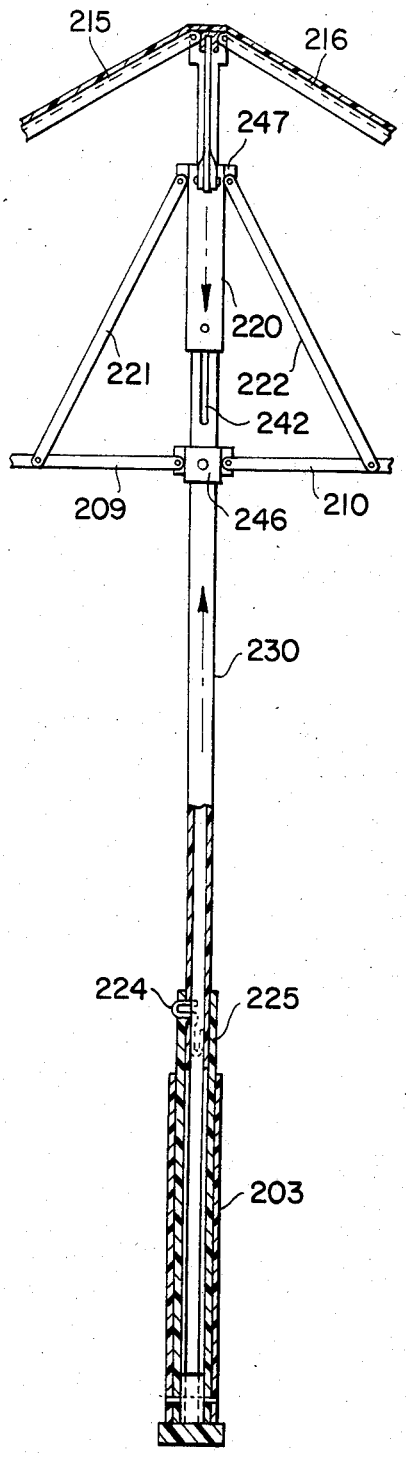
FIG. 16 is a partially sectioned view of this embodiment in an open position.

In FIG. 13 canopy 201 of umbrella 200 is stretched on rim members 211–214 and top support members 215 and 216 which support members are better seen in FIG. 16. Instead of a strip 104, a hook 248 engages catch 249 when the umbrella 200 is closed to keep it securely closed.

Figure 15:
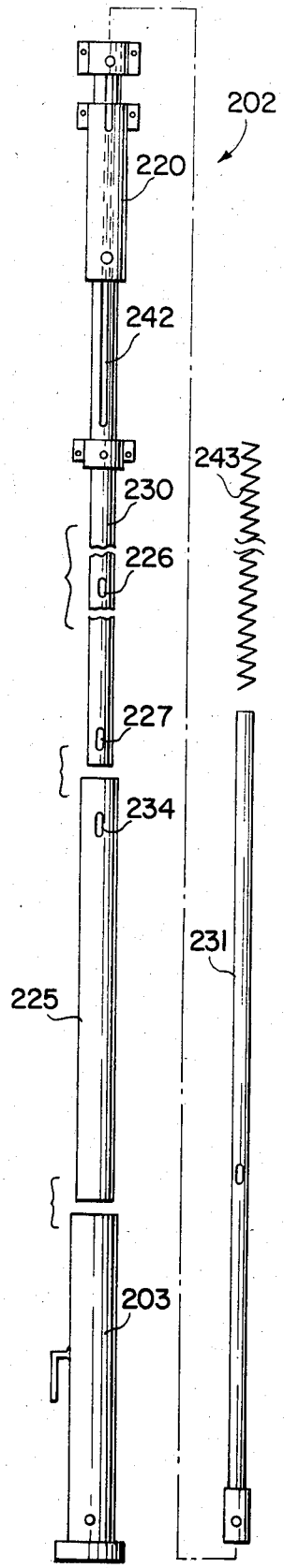
FIG. 15 is an exploded view of the handle and center shaft mechanism of the embodiment of FIG. 13.

In these figures illustrating the second embodiment, the center shaft 202 shown in exploded view in FIG. 15 and sectioned in other views has a center extending rod 231 with a hole 223 through which a spring clip 224 mounted within rod 231 protrudes and is pushed through a hole 234, when aligned therewith, in tube 225 which is mounted and pinned into place in handle 203. Hollow tubular shaft 230 has holes 226 and 227 therein also to receive the protruding portion of spring clip 224 when it is aligned with those holes with the umbrella 200 in either the fully open or fully closed position. Tubular sliding member 220 is pinned to center extending rod 231 through slot 242 in hollow tubular shaft 230. Spring 243 is compressed in the upper end of hollow tubular shaft 230 by the end of center rod 231.

Circular eared connectors 246 and 247 are mounted respectively on hollow tubular shaft 230 and sliding member 220 to serve as pivotal connections to these parts. Upwardly extending supports 209 and 210 are pivotally connected to connector 246 on one end and to hinges 205 and 206 on their opposite ends which hinges connect rim members 213 and 214 on one side and rim members 212 and 211 on the other side of the umbrella. Intermediate connecting members 221 and 222 are pivotally connected with connector 247 on one of their ends and have the other of their ends pivotally connected to supports 209 and 210 respectively. Intermediate connecting members substantially equivalent to parts 117 and 118 are also pivotally connected to connector 247 on one of their ends and pivotally connected to top support members 215 and 216 on the other of their ends. As can be seen this upper structure of the umbrella is very similar in most respects in both embodiments shown and operates in a similar manner. Therefore the operation of the umbrellas is not again discussed here.

Figure 14:
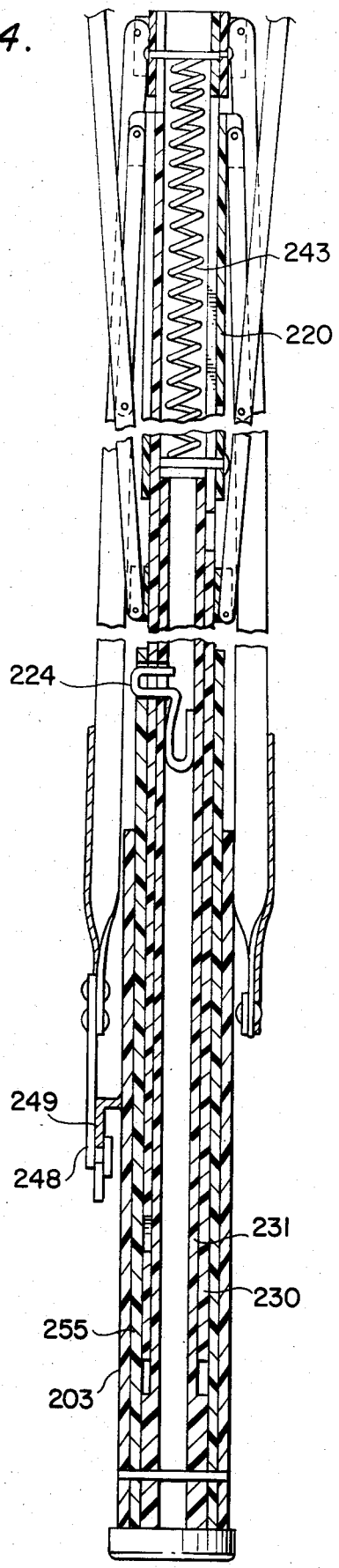
FIG. 14 is a sectioned view along line 14—14 of FIG. 13 with the umbrella in a closed position.

It should be noted as shown in FIG. 14 that the handle 203, tube 225 extending from the handle, and an enlarged portion at the bottom of center extending rod 231 are all pinned together so as to move together along with sliding member 220 relative to hollow tubular shaft 230 to open and to close umbrella 200.

Figure 17:
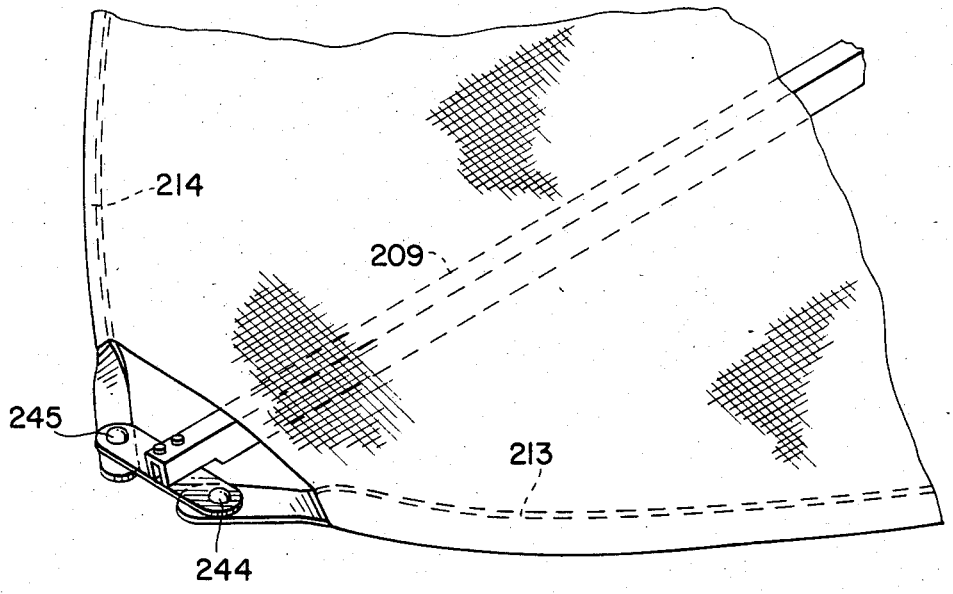
FIG. 17 is an enlarged view of a rim tip of this embodiment of the invention.

In FIG. 17 an enlarged view of a rim tip 205 shows a T shaped end with pivotal connections to rim members where the rim members extend beyond the pivot points to allow use of the umbrella as a walking stick as previously described in relation to the first embodiment.

It will be obvious to those skilled in the art that various changes may be made without departing from the scope of the invention and the invention is not to be considered limited to what is shown in the drawings and described in the specification.

I claim:

1. An umbrella comprising a domed shaped canopy including fabric attached to a hoop;

said hoop comprised of rim members prestressed in a convex shape havng a substantially less convex straight shape with the umbrella in a closed position and having a convex shape with the umbrella in an open position;

means to connect said rim members to each other;

and means to move said canopy between said open and closed positions including a center shaft means extending through said hoop of said rim members and surrounded by said rim members when the umbrella is closed.

2. The umbrella of claim 1 further characterized by said means to move said canopy including said center shaft means including a handle;

a center rod extending into one end of said handle and fixedly connected to said handle near the opposite end of said handle;

a hollow shaft slidingly mounted on said center rod and having an opening slot therethrough;

a sliding member slidingly mounted on said hollow shaft and fixedly connected to said center rod through said opening slot;

and strut means connecting said rim means to said center shaft means.

3. The umbrella of claim 2 further characterized by said strut means including a pair of top support members having one end of each of them pivotally connected to the top end of said hollow shaft on opposite sides of said hollow shaft and having the other end of each of them pivotally connected to a pair of said rim members;

a pair of extending members pivotally connected to said hollow shaft at an intermediate point on said hollow shaft and on opposite sides of said hollow shaft and having the other end of each of them pivotally connected to a pair of said rim members at ends of said rim members differing from the ends at which said pair of top support members are connected;

two pairs of intermediate connecting members each pivotally connected to said sliding member at one of their ends and with one pair having their other ends pivotally connected to said top support members at an intermediate point thereon and with the other pair having their other ends pivotally connected to said pair of extending members at an intermediate point thereon.

4. The umbrella of claim 3 further characterized by said sliding member mounted for sliding on the portion of said hollow shaft between the points of pivotal connection of said pair of top support members and of said pair of extending members to said hollow shaft.

5. The umbrella of claim 2 further characterized by a locking means to lock the umbrella in either an open or a closed position including a plunger passing through said handle and through the side of said hollow shaft in either of two positions of said hollow shaft relative to said handle.

6. The umbrella of claim 2 further characterized by a locking means to lock the umbrella in either an open or a closed position including a spring clip mounted in said center rod and protruding therethrough into said hollow shaft.

7. The umbrella of claim 3 further characterized by pivotal means attached to said top support members at the said end of said top support member connected to a pair of said rim members;

a pivot point on each end of said pivotal means;

an end of each of a pair of rim members connected to one of each of said pivot points and extending beyond said pivot point whereby the portions of said rim members extending beyond said pivot point are used as tips on the part of the umbrella contacting the ground when the umbrella is used as a walking stick.

8. The umbrella of claim 1 further characterized by said fabric connected to said prestressed rim members with fibers running in the direction with the bias of the fibers substantially perpendicular to said rim members to permit maximum stretch on the bias.

9. The umbrella of claim 7 further characterized by said hoop forming a smooth round shaped canopy along the adjacent ends of said rim members.

10. The umbrella of claim 1 further characterized by said prestressed rim members being formed of laminated pieces with the outermost laminated piece of said convex shaped rim members having a series of cuts along said laminated piece transversely of the length of said piece.

11. The umbrella of claim 1 further characterized by said prestressed rim members being formed of spring steel prestressed to form a convex shaped canopy.

* * * * *